US005637158A

United States Patent [19]

Arnold et al.

[11] Patent Number: 5,637,158

[45] Date of Patent: Jun. 10, 1997

[54] METHOD FOR THE MANUFACTURE OF AN EXPANSIBLE ANCHOR CONSISTING OF CORROSION-RESISTANT STEEL

[75] Inventors: Norbert Arnold, Waldachtal; Bernd Hein, Freudenstadt; Paul Gümpel, Bodman-Ludwigshafen, all of Germany

[73] Assignee: fischerwerke Artur Fischer GmbH & Co. KG, Waldachtal, Germany

[21] Appl. No.: 565,072

[22] Filed: Nov. 30, 1995

[30] Foreign Application Priority Data

Dec. 17, 1994 [DE] Germany ..... 44 45 154.7

[51] Int. Cl.[6] ..... C23C 8/06

[52] U.S. Cl. ..... 148/220; 148/225; 148/529

[58] Field of Search ..... 148/220, 225, 148/529

[56] References Cited

U.S. PATENT DOCUMENTS

| | | | |
|---|---|---|---|
| 4,099,993 | 7/1978 | Muller et al. | 148/225 |
| 4,918,806 | 4/1990 | Watanabe et al. | 148/220 |

FOREIGN PATENT DOCUMENTS

| | | | |
|---|---|---|---|
| 0378925 | 12/1989 | European Pat. Off. . | |
| 512254 | 2/1992 | European Pat. Off. | 148/225 |
| 3320460 | 7/1983 | Germany . | |
| 6-192737 | 7/1994 | Japan | 148/220 |

OTHER PUBLICATIONS

Metallwissenschaft + Technik, 43, vol. 10, Oct. 1989, pp. 963–967, Beuers et al.

Beton– und Stahlbetonbau, 9, 1982, p. A30.

*Primary Examiner*—George Wyszomierski
*Attorney, Agent, or Firm*—Michael J. Striker

[57] ABSTRACT

A method of manufacturing an expansible anchor comprises the steps of forming one part as a partially slotted expansible sleeve composed of corrosion-resistant steel and anchorable in a building component, forming another part as an expander body composed of corrosion-resistant steel and arranged to be driven into the expansible sleeve so as to anchor the expansible sleeve in the building component, enriching one of the parts with interstitially dissolved, non-metallic alloying constituents selected from the group consisting of carbon, nitrogen and boron, and ageing by heat treating so as to precipitate the alloying constituents in the form selected from the group consisting of carbides, nitrides and borides, respectively, to achieve increased hardness.

5 Claims, No Drawings

METHOD FOR THE MANUFACTURE OF AN EXPANSIBLE ANCHOR CONSISTING OF CORROSION-RESISTANT STEEL

BACKGROUND OF THE INVENTION

The invention relates to a method, in particular for the manufacture of an expansible anchor consisting of corrosion-resistant steel having an expansible sleeve and an expander body.

Expansible anchors consisting of corrosion-resistant steel having an expansible sleeve slotted for a part of its length and an expander body with an expander cone which is arranged to be driven into the expansible sleeve in order to anchor the expansible anchor are well enough known. When anchoring the known expansible anchor, the high expansion pressure during the anchoring process can lead to binding of the two surfaces of the expander body and expansible sleeve that are in sliding contact with one another. This binding considerably impairs the function of the expansible anchor. Such an anchor is in particular unsuitable for use in the zone subject to tensile forces, since enlargement of the drilled hole as a result of cracks forming cannot be compensated for because of the lack of subsequent expansion behavior.

For that reason, in the case of expansible metal anchors it is customary to use steels of different structural constitution for the two metal parts that are in sliding contact. Since, however, these parts can be manufactured and supplied only in large numbers, this option is not always applicable, especially in the case of stainless steel anchors. Moreover, neither is it possible to achieve an acceptable homogeneity in the structural constitution of the steels which effects a reduction in the tendency to bind with satisfactory reliability.

To reduce the tendency to bind, it is moreover known to provide one or both metal parts with a coating. This coating, which is applied, for example, by an immersion process or by spraying, is very thin and has little resistance. During the anchoring process the coating can consequently be scraped off, so that the sliding behavior for subsequent expansion in the event of enlargement of the drilled hole as a result of cracks forming is considerable impaired. Moreover, such a coating also does not guarantee the long-term behavior of the expansible fixing plug in respect of subsequent expansion.

SUMMARY OF THE INVENTION

Accordingly, it is an object of the present invention to provide a method for the manufacture of an expansible anchor consisting of corrosion-resistant steel, which avoids the disadvantages of the prior art.

In keeping with these objects and with others which will become apparent hereinafter, one feature of the present invention resides, briefly stated, in a method which has the following steps: forming one part as a partially slotted expansible sleeve composed of corrosion-resistant steel and anchorable in a building component, forming another part as an expander body composed of corrosion-resistant steel and arranged to be driven into the expansible sleeve so as to anchor the expansible sleeve in the building component, enriching one of the part of the parts with interstitially dissolved, non-metallic alloying constituents selected from the group consisting of carbon, nitrogen and boron, and ageing by heat treating so as to precipitate the alloying constituents in the form selected from the group consisting of carbides, nitrides and borides, respectively, to achieve increased hardness.

When the method is performed in accordance with the present invention favorable sliding behavior allowing subsequent expansion in the event of enlargement of the drilled hole as a result of cracks forming is ensured over a long period.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

In accordance with the present invention, an expansible anchor is manufactured consisting of corrosion-resistant steel having a partially slotted expansible sleeve which is anchorable in a building component by means of an expander body which is arranged to be driven into the expansible sleeve. In accordance with the inventive method, the starting of one of these parts, preferably the expander body is enriched with interstitially dissolved, non-metallic alloying constituents such as carbon (C), nitrogen (N) and/or boron (B), and by an ageing by heat treatment these alloying constituents are precipitated in the form of carbides, nitrides and/or borides to achieve increased hardness.

In the case of corrosion-resistant steels with high contents of interstitially dissolved non-metallic alloying constituents, such as carbon, nitrogen and/or boron, these alloying constituents can be precipitated in the form of carbides, nitrides and/or borides by an ageing by heat. treatment process. These very hard particles cause increased hardness with the effect that the tendency to cold welding and binding is reduced. Beyond the increased hardness, for example, of the expander body compared with the expansible sleeve favorable and lasting sliding behavior is ensured both for the expansion process and for subsequent expansion in cracked concrete. If these non-metallic alloying constituents are not present in the basic composition of the corrosion-resistant steel, they are added by alloying or, if they are present, their content is increased. Increasing the nitrogen content can be effected, for example, by the known methods of pressure-nitrogenization. During the ageing by heat treatment process, the precipitated non-metallic alloying constituents are stabilized as a result of equilibrium being established in the state of precipitation.

To avoid local chromium depletion, which encourages corrosion, it is advantageous also to increase the chromium content of the corrosion-resistant steel with respect to the basic alloy.

To obtain a high resistance to corrosion, in addition to the precipitate-forming non-metallic alloying constituent of carbon, nitrogen and/or boron, yet further elements for carbide formation such as vanadium, titanium and/or niobium can be added by alloying. These additional alloying elements prevent the formation of pure chromium carbides, which reduce resistance to corrosion.

The materials according to the invention can be produced on the one hand by powder-metallurgy techniques and processed in the customary machining processes. It is equally possible, however, to manufacture the expander body from the material according to the invention in a simple manner by powdered metal injection-molding. In this method the precipitate-forming alloying elements are admixed with the powdered metal having the basic composition. After injection-molding the expander body in an injection-molding tool and removing the binders and sintering the expander body, the ageing by heat treatment process takes place, in which the alloying constituents carbon, nitrogen and/or boron are precipitated in the form of carbides, nitrides and/or borides to achieve increased hardness.

EXAMPLE 1

Basic composition of the alloying elements of a corrosion-resistant steel with the increased content of the precipitate-forming alloying constituents.

| Basic composition | | Enriched to | |
|---|---|---|---|
| C | 0.03 | | |
| Si | 0.5 | | |
| Mn | 18.2 | | |
| S | 0.003 | | |
| Cr | 18.5 | | |
| Mo | 2.3 | | |
| N | 0.15 | N | 0.9 |

Nitrides are precipitated.

EXAMPLE 2

| Basic composition | | Enriched to | |
|---|---|---|---|
| C | 0.02 | | |
| Si | 0.1 | | |
| Mn | 1.5 | | |
| Cr | 23.0 | Cr | 26.0 |
| Ni | 14.0 | | |
| Mo | 2.0 | | |
| B | 0.05 | B | 1.5 |

Borides are precipitated.

EXAMPLE 3

| Basic composition | | Enriched to | |
|---|---|---|---|
| C | 2.4 | C | 3.7 |
| Cr | 12.0 | Cr | 24.5 |
| Mo | 3.1 | | |
| V | 1.0 | V | 9.0 |

Vanadium carbides are precipitated.

It will be understood that each of the elements described above, or two or more together, may also find a useful application in other types of methods differing from the types described above.

While the invention has been illustrated and described as embodied in a method for the manufacture of an expansible anchor consisting of corrosion-resistant steel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of manufacturing an expansible anchor, comprising the step of forming one part as a partially slotted expansible sleeve composed of corrosion-resistant steel and anchorable in a building component; forming another part as an expander body composed of corrosion-resistant steel and driveable into the expansible sleeve so as to anchor the expansible sleeve in the building component; enriching one of said parts composed completely of the corrosion resistant steel with non-metallic alloying constituents which are interstitially dissolved throughout the one of said parts and selected from the group consisting of carbon, nitrogen and boron; and ageing by heat treating so as to precipitate carbides, nitrides and/or borides, respectively, to achieve increased hardness in said one of said parts.

2. A method as defined in claim 1, wherein said step of enriching includes enriching the expander body.

3. A method as defined in claim 1, wherein said forming another part includes using a corrosion resistant steel with a high chromium content.

4. A method as defined in claim 1, further comprising the step of adding by alloying a carbide forming element selected from the group consisting of vanadium, titanium and niobium to said one of said parts.

5. A method of manufacturing an expansible anchor, comprising the step of forming one part as a partially slotted expansible sleeve composed of corrosion-resistant steel and anchorable in a building component; forming another part as an expander body by powered metal injection molding, said body composed of corrosion-resistant steel and driveable into the expansible sleeve so as to anchor the expansible sleeve in the building component; enriching one of said parts composed completely of the corrosion resistant steel with non-metallic alloying constituents which are interstitially dissolved throughout the one of said parts and selected from the group consisting of carbon, nitrogen and boron; and ageing by heat treating so as to precipitate carbides, nitrides and/or borides, respectively, to achieve increased hardness in said one of said parts.

* * * * *